United States Patent [19]

Harbaugh

[11] 4,148,326

[45] Apr. 10, 1979

[54] AUTOMATIC LOADING BONG

[76] Inventor: Ricky A. Harbaugh, 3505 Anderson Rd., Kensington, Md. 20795

[21] Appl. No.: 781,881

[22] Filed: Mar. 28, 1977

[51] Int. Cl.[2] ..... A24F 1/02; A24F 1/26

[52] U.S. Cl. ..... 131/173; 131/180

[58] Field of Search ..... 131/70, 180, 181, 173; 222/544

[56] References Cited

U.S. PATENT DOCUMENTS

| | | | |
|---|---|---|---|
| 1,055,842 | 3/1913 | Warden, Jr. | 131/180 |
| 3,863,646 | 2/1975 | Kahler | 131/173 |
| 4,044,781 | 8/1977 | Heggestuen | 131/180 |

OTHER PUBLICATIONS

Research & Industry, vol. 19, Sep. 1974, p. 96.

*Primary Examiner*—Robert W. Michell
*Assistant Examiner*—V. Millin
*Attorney, Agent, or Firm*—Mitchell B. Wasson

[57] ABSTRACT

A smoking device such as a bong, or water pipe, for smoking rare and expensive tobacco whereby the smoke is filtered by a liquid substance such as water before it is inhaled by the user. The bong includes a smoking bowl for holding the tobacco and allowing the smoke generated therefrom to be filtered through the liquid. To facilitate the placing of the tobacco in the smoking bowl, an automatic loader is employed.

3 Claims, 3 Drawing Figures

AUTOMATIC LOADING BONG

FIELD OF THE INVENTION

The present invention relates generally to a smoking device such as a bong or water pipe for use in the smoking of rare and expensive tobaccos.

BACKGROUND OF THE INVENTION

The prior art is replete with smoking devices whereby the smoke is filtered by a liquid such as water or wine before it is inhaled by the user. Each of these smoking devices must contain a smoking bowl for receiving the tobacco. This bowl contains a small aperture in its base so that the smoke generated from lighting the tobacco may be filtered by the liquid before it is inhaled. Generally, this bowl is very small in volume and consequently, it must be refilled many times in a short period of time. After each of these refilling operations have been completed, the substance must then again be re-lit. However, due to the compact nature of the design of the prior art bongs, the users fingers may repeatedly be burnt when the tobacco is manually placed into the bowl.

Representative of these prior art bongs are U.S. Pat. Nos. 3,863,646 and 3,872,872 issued to Richard Kahler. Both of these patents described smoking devices whereby the smoke is filtered through a liquid before it is inhaled. Each smoking device utilizes a small bowl to contain the tobacco. Consequently, each and every time the bowl is filled, the user runs the risk of burning his fingers. Other examples of prior art water pipes are U.S. Pat. Nos. 3,394,710 issued to Ping-Chuan; 3,805,806 issued to Grihalva; 3,882,875 issued to Frost; and 3,881,499 issued to McFadden et al.

SUMMARY OF THE INVENTION

The present invention overcomes the defects of the prior art by including an automatic loader adapted to cooperate and align with the smoking bowl of a standard bong. This loader can either be permanently or removably mounted to the main bong body. A swivel joint is utilized to allow the loader to be aligned with the bowl, enabling the tobacco to be loaded into said bowl. Additionally, this joint enables the loader to be swivelled into a position to facilitate the lighting of the tobacco. A plug valve is included to allow the flow of tobacco into the bowl to be controlled.

BRIEF DESCRIPTION OF THE DRAWINGS

The specific nature of the invention as well as other objects and advantages thereof will clearly be apparent from the following description and the associated drawings.

DETAILED DESCRIPTION OF THE PREFERRED EMBODIMENT

Figure 1:
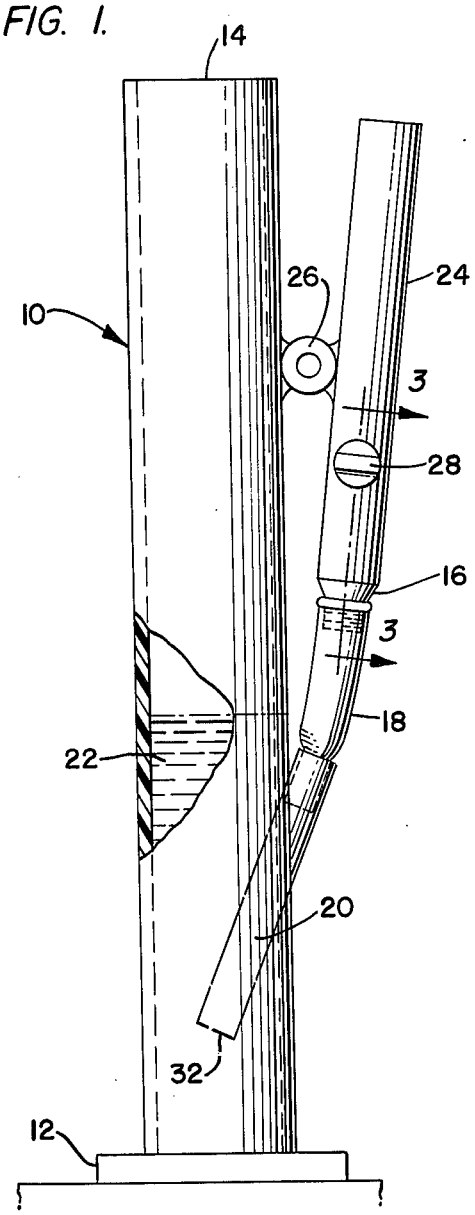
FIG. 1 is a front view of the bong in its loading position.
Figure 2:
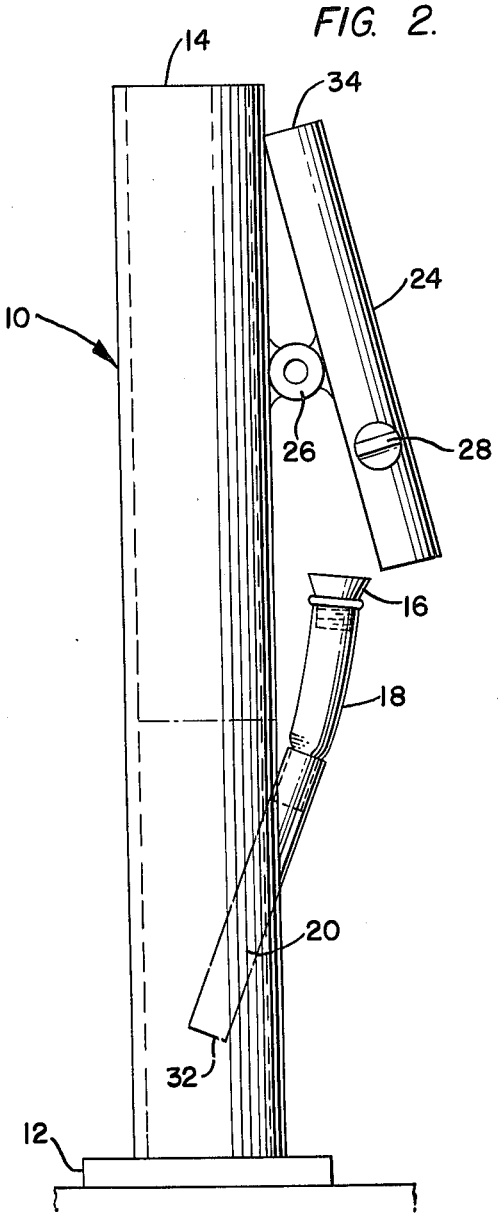
FIG. 2 is a front view of the bong when it is in position for lighting the tobacco.
Figure 3:
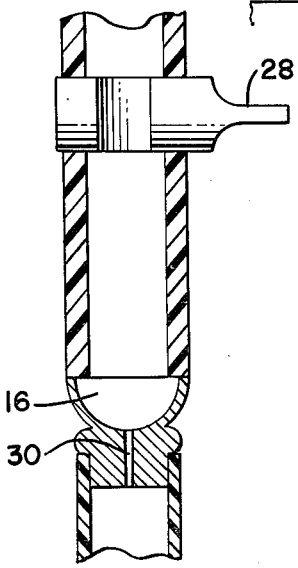
FIG. 3 is a cross-sectional view of FIG. 1 taken through the lines 3—3.

As shown in FIGS. 1 and 2, the automatic loading bong consists of a hollow member 10 preferably having an elliptical or circular cross section, said hollow member capable of maintaining a volume of fluid therein. The member 10 contains a closed base 12 and an open top 14. The bottom portion of the member 10 contains an elliptical hole through which a tube member 20 is inserted, with a water-tight seal applied to the junction of the outside wall of member 10 and 20 to ensure the integrity of the seal. A second tube 18 is affixed to the upper portion of tube 20. A smoking bowl 16 is threaded or otherwise inserted into the upper portion of tube 18.

A filler tube 24 is swivelly attached to the upper portion of hollow member 10 by means of swivel joint 26. This swivel joint 26 allows the filler tube 24 to be aligned with bowl 16 (FIG. 1) to load the tobacco therein and also allows the tube 24 to be moved away from bowl 16 to facilitate the igniting of the tobacco. The filler tube 24 also contains a standard two-position rotatable plug 28 having an irregular cross-sectional area for controlling the flow of tobacco into the smoking bowl 16. In the closed position as shown in FIGS. 1 and 2, the tobacco would be able to flow directly into the smoking bowl 16. However, when the plug 28 is rotated 90° in both directions the flow of material through the filler tube 24 is inhibited. It can be appreciated, however, that the plug 28 may be replaced with other means suitable to control the flow of tobacco through the filler tube 24 and into the smoking bowl 16. Additionally, the filler tube 24 can be permanently affixed to the hollow member 10 as is shown in FIGS. 1 and 2, or alternatively, the tube 24 can be removably affixed to hollow member 10 by means well known in the prior art.

In operation, water, wine, or any other liquid filtering substance 22 is introduced into the hollow member 10 through top 14 to a suitable level such that the bottom orifice 32 of tube 20 is submerged. With plug 28 in the closed position, a measured amount of tobacco is introduced into filler tube 24. When this has been accomplished and with filler tube 24 aligned with bowl 16, as shown in FIG. 1, plug 28 is rotated to allow a tobacco to flow into the smoking bowl 16. Tube 24 is then swivelled away from the smoking bowl 16 so that its upper end 34 abuts the upper end of hollow member 10. The automatic loading bong is now in the appropriate position so that the tobacco contained within bowl 16 can be lit. The smoke produced will flow through aperture 30 of the bowl 16, into lower tube 20 and then be filtered by the liquid 22. To inhale, the user need merely place his mouth over the top portion 14 of the bong. Additionally, to facilitate the inhalation process, a mouth piece means (not shown) could be placed above the top 14 of hollow member 10. Although it is not essential for the present invention, it has been found that superior results have been produced by constructing the hollow member 10, filler tube 24, and upper tube 18 from plexiglass. The smoking bowl 16 can be constructed from most any metallic composition. Additionally, a single tube may be used instead of tubes 18 and 20.

While the invention has been particularly shown and described with reference to a preferred embodiment thereof, it will be understood by those skilled in the art that various changes in form and details may be made therein without departing from the spirit and scope of the invention.

What is claimed is:

1. A smoking device comprising:

a hollow member capable of maintaining a volume of liquid therein, said hollow member containing an open end and a closed end;

a tube containing an upper end and lower end, said lower end of said tube inserted into said hollow member;

a smoking bowl inserted into the said upper end of said tube;

filler means affixed to said hollow member by a swivel joint such that one end of said filler means can be aligned with said smoking bowl, said filler means including only a single cylindrical tube.

2. A smoking device in accordance with claim 1 wherein said filler means further includes a two-position rotatable plug.

3. A smoking device in accordance with claim 1 wherein said filler means is directly affixed to said smoking bowl.

* * * * *